US011986871B2

(12) United States Patent
Kirchner

(10) Patent No.: US 11,986,871 B2
(45) Date of Patent: May 21, 2024

(54) CROSS-ROLLING UNIT AND METHOD FOR ADJUSTING A ROLL GAP

(71) Applicant: SMS group GmbH, Duesseldorf (DE)

(72) Inventor: Walter Kirchner, Moenchengladbach (DE)

(73) Assignee: SMS group GmbH, Duesseldorf (DE)

( * ) Notice: Subject to any disclaimer, the term of this patent is extended or adjusted under 35 U.S.C. 154(b) by 0 days.

(21) Appl. No.: 17/883,795

(22) Filed: Aug. 9, 2022

(65) Prior Publication Data

US 2023/0047972 A1 Feb. 16, 2023

(30) Foreign Application Priority Data

Aug. 10, 2021 (DE) ..... 10 2021 120 784.3
Nov. 24, 2021 (DE) ..... 10 2021 130 840.2

(51) Int. Cl.

| | |
|---|---|
| ***B21B 37/62*** | (2006.01) |
| ***B21B 1/16*** | (2006.01) |
| ***B21B 1/22*** | (2006.01) |
| ***B21B 13/00*** | (2006.01) |
| ***B21B 13/10*** | (2006.01) |
| ***B21B 31/00*** | (2006.01) |
| ***B21B 31/32*** | (2006.01) |

(52) U.S. Cl.
CPC ..... *B21B 37/62* (2013.01); *B21B 13/10* (2013.01)

(58) Field of Classification Search
CPC ..... B21B 13/10; B21B 13/008; B21B 31/22; B21B 31/32; B21B 31/20; B21B 1/16; B21B 37/62
USPC ..... 72/248, 245
See application file for complete search history.

(56) References Cited

U.S. PATENT DOCUMENTS

2006/0191308 A1 8/2006 Denker
2008/0016932 A1 1/2008 Denker
2021/0316346 A1* 10/2021 Bender ..... B21B 31/07

FOREIGN PATENT DOCUMENTS

DE 12 85 431 B 12/1968
DE 1806680 A1 * 5/1970
(Continued)

OTHER PUBLICATIONS

English translate (DE1806680A1), retrieved date Sep. 13, 2023.*
English translate (DE2618828A1), retrieved date Sep. 13, 2023.*

*Primary Examiner* — Matthew Katcoff
*Assistant Examiner* — Mohammed S. Alawadi
(74) *Attorney, Agent, or Firm* — Collard & Roe, P.C.

(57) ABSTRACT

In order to provide an adjustment of the roll gap under load with high positioning accuracy and regulation accuracy, a cross-rolling unit for adjusting rolls operating under load with, disposed on a force-absorbing roll stand, a mechanical setting unit for a first cross-roll setting and a hydraulic setting unit for a second cross-roll setting, wherein the mechanical setting unit includes two mutually displaceable mechanical subassemblies having a common axis of symmetry and the hydraulic setting unit includes at least two mutually displaceable hydraulic subassemblies having respectively one central axis, has the mechanical setting unit and the hydraulic setting unit disposed in the force-absorbing roll stand as a common subassembly. The axis of symmetry of at least one of the mutually displaceable mechanical subassemblies and the central axes of each of the mutually displaceable hydraulic subassemblies are the same.

15 Claims, 3 Drawing Sheets

(56) References Cited

FOREIGN PATENT DOCUMENTS

| | | | | |
|---|---|---|---|---|
| DE | 2618828 | A1 | * | 11/1977 |
| DE | 103 12 122 | B3 | | 8/2004 |
| DE | 10 2016 114 377 | A1 | | 3/2017 |
| FR | 0267165 | A2 | * | 5/1988 |
| GB | 1027704 | A | | 4/1966 |

* cited by examiner

CROSS-ROLLING UNIT AND METHOD FOR ADJUSTING A ROLL GAP

CROSS REFERENCE TO RELATED APPLICATIONS

Applicant claims priority under 35 U.S.C. § 119 of German Application No. 10 2021 120 784.3 filed Aug. 10, 2021 and German Application No. 10 2021 130 840.2 filed Nov. 24, 2021, the disclosures of which are incorporated by reference.

BACKGROUND OF THE INVENTION

1. Field of the Invention

The invention relates to a cross-rolling unit for adjusting rolls operating under load with, disposed on a force-absorbing roll stand, a mechanical setting unit for a first cross-roll setting and a hydraulic setting unit for a second cross-roll setting, wherein the mechanical setting unit comprises two mutually displaceable mechanical subassemblies with a common axis of symmetry and the hydraulic setting unit comprises at least two mutually displaceable hydraulic subassemblies with respectively one central axis. The invention also relates to a method for adjusting a roll gap in rolls, operating under load, of a cross-rolling mill with a mechanical setting unit and a hydraulic setting unit disposed on a force-absorbing roll stand.

2. Description of the Related Art

Such are known from DE 10 2016 114 377 A1, although in that case the exact configuration of the cross-roll setting is not addressed. At best the use of threads as the mechanical cross-rolling setting or, alternatively thereto, the use of hydraulic cross-roll settings is disclosed in that publication.

On the other hand, roll stands that operate with back-up rolls and working rolls are known quite generally from DE 12 85 431, wherein a roll gap can be set up via a thrust spindle and mechanically adjusted via a spindle. In corresponding rolling mills, the actual set-up of the roll gap takes place via back-up rolls, which transfer the rolling force to the working rolls. The set-up of the rolls takes place purely mechanically. In corresponding roll stands, which operate with back-up rolls and working rolls and are known, for example, from DE 103 12 122 B3, a mechanical setting of the back-up and working rolls first takes place mechanically via several outer thrust spindles, which are disposed in offset relation to a central setting cylinder, which hydraulically sets up the roll-setting force in the second step. These roll stands are not of the stated type, however, because their configuration makes them completely unsuitable for cross-rolling. Above all, the mounting of the rolls appears completely unsuitable for the cross-rolling.

SUMMARY OF THE INVENTION

An object of the invention is to provide an adjustment of the roll gap under load with high positioning accuracy and regulation accuracy.

These and other object are achieved by a cross-rolling unit and by an adjustment method having the features according to the invention. Further advantageous configurations, some even independent thereof, are presented below.

For an adjustment of the roll gap under load with high positioning accuracy and regulation accuracy, a cross-rolling unit for adjusting rolls operating under load with, disposed on a force-absorbing roll stand, a mechanical setting unit for a first cross-roll setting and a hydraulic setting unit for a second cross-roll setting, wherein the mechanical setting unit comprises two mutually displaceable mechanical subassemblies having a common axis of symmetry and the hydraulic setting unit comprises at least two mutually displaceable hydraulic subassemblies having respectively one central axis, can be characterized in that the mechanical setting unit and the hydraulic setting unit are disposed in the force-absorbing roll stand as a common subassembly, wherein the axis of symmetry of at least one of the mutually displaceable mechanical subassemblies and the central axes of each of the mutually displaceable hydraulic subassemblies are the same.

"Rolling" will preferably be understood in the present context as a fabrication method from the group of pressure forming, in which the material is formed between two or more rotating tools and in the process its cross section is reduced. If the forming takes place above the recrystallization temperature of the material, it is known as hot-rolling; otherwise it is cold-rolling. At the first classification level, rolling methods are distinguished in how the workpiece movement takes place relative to the axes of the rolls. Thus, it is possible to distinguish between longitudinal rolling, transverse rolling and cross rolling.

In this distinction, that rolling process in which the rolls have roll axes inclined toward one another or relative to the rolling axis is first to be referred to as a cross-rolling process. In the narrower sense, however, only rolling processes in which the rolls having appropriately inclined roll axes impart both a longitudinal and a rotary movement to the workpiece are to be referred to as a cross-rolling process.

Cross-rolling can be used for rolling not only billets and ingots but also hollow billets and hollow ingots, i.e. both solid and hollow workpieces. In particular, it is also possible to pierce solid workpieces by means of a cross-rolling process. In the latter, a piercing mandrel in particular is used. Mandrels or mandrel bars can also be used as internal tools in other cross-rolling processes, wherein rolling then takes place in particular on radially outwardly pointing faces of such inner tools. If applicable, support rulers, back-up rolls or support and Diescher disks may also be provided to implement the cross-rolling process appropriately.

Depending on specific implementation, the workpiece can be subjected to a very complex flexing work of compression and tension during cross-rolling, whereby it is possible to penetrate very deeply and intensively into the milled material. In the process, especially the exact shape and positioning of the cross rolls and of the roll pass resulting from this in interaction with the rotary and longitudinal motion produced from it is a decisive factor.

Thus, the adjustment of the rolls during a cross-rolling process can be understood under "cross-roll setting". As already explained in the foregoing, this setting falls under the parameters, to be established during cross-rolling, that are important for the process, in order to be able to permit a rolling process that is as accurate and defect-free as possible.

As a rule, a cross-roll setting of the rolls does not take place under load, especially during cross-rolling, i.e. without the action of rolling forces on the rolls. Recently, however, efforts to adjust the rolls operating under load have been made even during cross-rolling. The latter then permits interventions during the rolling, so that, for example by in-line and on-line measurements, regulating circuits can be closed in which a cross-roll setting can take place during the rolling, i.e. while rolls are operating under load.

In particular, an "adjustment of rolls operating under load" can therefore be understood to the effect that the rolls of the associated cross-rolling unit can be adjusted under load or when they are operating under load. In particular, it may also be understood by this that the rolls of the corresponding cross-rolling unit will be adjusted or can be adjusted during the rolling, i.e. while they are loaded with rolling forces.

The rolls may be disposed in normal manner on a roll stand capable of absorbing the forces, especially the rolling forces, that occur during rolling. The roll stand therefore preferably ensures that the forming forces introduced into the respective workpiece are absorbed as rolling forces and thus an appropriate force compensation is created, without which an application of forming forces would not be possible at all but would result in some kind of accelerations.

In general, a "setting unit" in the present connection is preferably any device that is capable of permitting a cross-roll setting, especially even under load if necessary. For this purpose, the setting unit preferably has at least two mutually displaceable subassemblies, of which one is preferably disposed on the roll-stand side or on the roll stand and the other is preferably disposed on the roll-stand side or on a roll seat or is constructed as the roll-stand side or the roll seat. By means of a displacing device, which is capable of displacing these two subassemblies relative to one another, it is then possible to achieve a cross-roll setting. Purely mechanical devices, such as worm or spindle gears, which are displaced manually or by motor, for example by electric motor, or even hydraulic displacing devices, for example, which usually comprise a cylinder and a piston, come into question as displacing devices. In particular, however, a displacing device on the one hand and a fixing device on the other may be provided, wherein the latter then serves to fix the two subassemblies relative to one another, so that forces do not have to be constantly applied by the displacing device.

A mechanical setting unit can accordingly comprise two mutually displaceable subassemblies and ensure that these two subassemblies can be mechanically displaced relative to one another, which may be accomplished in different ways. If necessary, a setting may be undertaken purely manually. For example, this setting may happen in that the roll-side subassembly is offset manually and fixed in the desired position. For this purpose, the displacing device may comprise in particular appropriate gears, such as screw drives or thread drives. Depending on specific implementation, these gears may then be driven manually in order to displace the roll-side subassembly. If necessary, self-locking capability may also be provided here, in order to facilitate appropriate fixation in the desired position. It will be understood that, in this regard, one or more appropriately active fixing devices may be provided instead of or in addition to a self-locking capability. Instead of or in addition to a manual displacement, appropriate motor drives, such as electromotor or even hydromotor drives, for example, may also be provided.

In particular, the mutually displaceable mechanical subassemblies preferably have a common axis of symmetry. Hereby the danger of twisting or tilting movements can be minimized.

An "axis of symmetry" of a mechanical subassembly may preferably be defined by the configuration of the corresponding subassembly. Thus, for example, a thread may be assigned to a central axis of symmetry, around which the thread ascends. The same applies for a nut as the corresponding mating piece. In particular, however, when two displacing devices operating in parallel—and in this respect possibly even two setting units operating in parallel—respectively act on one of the two subassemblies and thus ultimately on both subassemblies also, a corresponding axis of symmetry follows from the arrangement of these two displacing devices operating in parallel. Alternatively, or alternatively as an axis of symmetry, a line may also be chosen that is defined by the resultant total force that is applied by the respective setting unit or its displacing device, whether the setting unit or displacing device is formed from separate parts or one part. In this regard, it is conceivable for a mechanical subassembly to be configured in a manner that clearly has a central axis. Thus, it may also be possible that an axis of symmetry of the mechanical subassemblies can even be the same as its central axis, as can be the case, for example, of a cylindrical shape. In particular, it is conceivable that two or even more setting units can operate in parallel on one of the two subassemblies and ultimately on both subassemblies, so that then possibly even the entirety of the setting units may be assigned to one axis of symmetry.

Correspondingly, a hydraulic setting unit may represent a unit in which two hydraulic subassemblies can be hydraulically displaced relative to one another. In the process, preferably one of the hydraulic subassemblies is joined with a piston and the second of the subassemblies with a cylinder, and a hydraulic displacement of cylinder and piston accordingly also causes a displacement of the two hydraulic subassemblies.

For this purpose, the two hydraulic subassemblies may respectively be assigned to one central axis, which ultimately is a question of the symmetry of these subassemblies or of the resultant forces applied by the hydraulics. "Central axis" may also be understood, for example, as a longitudinal axis, which denotes the axis of a body that corresponds to the direction of its greatest extent. Frequently, the longitudinal axis is also an approximate axis of symmetry of the body, which is the case, for example, of a cylindrical body.

Possibly displaceable subassemblies of the setting units may be guided in guideways, in order to minimize the danger of tilting and similar movements. On the other hand, it is also conceivable that, on the one hand, these guideways are in turn settable or, on the other hand, linearly independent further setting units act on these subassemblies, in order in this way to have more degrees of freedom with respect to the setting of the cross rolls.

The term "common subassembly" may preferably be understood to the effect that the hydraulic setting unit and the mechanical setting unit are joined with one another in one structural unit, so that these setting units in particular are in contact or in interaction with one another. In particular, the two setting units may have congruent subassemblies. For example, a subassembly of the one roll-side setting unit may represent the subassembly of the other roll-stand-side setting unit.

The displaceability of the two mechanical or hydraulic subassemblies relative to one another serves the setting or adjustment of the rolls and thus the set-up of the roll gap or roll pass, because the rolls are joined with the mechanical or roll-side hydraulic subassemblies in such a way that the rolls can also be displaced relative to one another by a displacement of the roll-side subassemblies.

By the agreement of axis of symmetry of at least one of the mutually displaceable mechanical subassemblies and the central axis of each of the mutually displaceable hydraulic subassemblies, the danger of tilting or twisting movements, which in particular could lead to inaccuracies in the setting during a setting under load, or else, which could be even more critical, could lead to damage, is minimized.

Preferably, a first of the two mechanical subassemblies is a spindle. A mechanical subassembly that works with a spindle has a high reliability, because a spindle can have a self-locking capability in appropriate configuration. In addition, high mechanical forces can be applied by a spindle in the simplest possible way. In addition, spindles permit a good force transfer during a mechanical adjustment. It is also conceivable, however, that mechanical setting units other than a spindle may be used that possibly could be used intentionally with respect to their individual advantages. It will be understood that several spindles with a corresponding common symmetry may also be used alternatively.

"Spindle" may be understood in the present connection as a clamping spindle, a tensioning spindle, a power spindle or even a high-pressure spindle, which are used in mechanical design for frictional clamping of heavy workpieces on large machines. Accordingly, these spindles may also be used for the force transmission in appropriate cross-rolling mills. The mechanical clamping spindles, such as can be used preferably in the present context, have a mechanical force transfer in the form of tensioning wedges or toggle levers. In both constructions, the force transfer is achieved by a sophisticated mechanism with high self-locking capability and operating safety. In addition, the performance features of the clamping spindles include very high clamping forces of 100 kN to 500 kN at low tightening torques, maximum operating safety, high stiffness, large clamping stroke and high alignment accuracy, a simple operation and assembly as well as low maintenance expense, so that in the present connection the use of a spindle as a mechanical subassembly of the mechanical setting unit proves to be particularly advantageous.

It is of advantage when a first of the two hydraulic groups is a cylinder. For hydraulic subassemblies of a hydraulic setting unit, a cylinder may represent a particularly advantageous configuration, which is related in particular with its compact construction. It is also conceivable, however, for the hydraulic subassembly to have a symmetric shape deviating from a cylinder, such as, for example, a prism or a cuboid, when this shape brings appropriate advantages for the desired arrangement. Even with such a cross section, such subassemblies would be referred to as the cylinder of a hydraulic setting unit. Moreover, the hydraulic subassembly may be a body that does not have any particular symmetry if it is accompanied with structural advantages. It is important that the hydraulic cylinder represent a cavity that can be filled with hydraulic fluid, in which a movable wall, usually formed by a piston, is disposed that yields to the pressure or a corresponding back-pressure applied by the hydraulic fluid, such as is caused, for example, by the rolling forces, until an equilibrium of forces prevails. In this way, a position of the piston can be defined by the pressure of the hydraulic fluid.

In the present connection, the cylinder is preferably a hydraulic cylinder, i.e. a fluid-operated working cylinder, which may also be referred to as a hydraulic linear motor. This device is usually viewed as an engine for the hydraulic consumers or users, when it converts the energy of the hydraulic fluid stored by a hydraulic pressure accumulator or a hydraulic pump into a linear movement. The predominantly used hydraulic cylinders are cylinders of round construction as well as tie rod cylinders.

It is of advantage when a second of the two hydraulic subassemblies is a piston, as already alluded to in the foregoing, whereby a particularly advantageous hydraulic configuration as well as a compact construction is achieved by a cylinder-piston arrangement. A hydraulic cylinder usually operates with a cylinder as well as with a corresponding piston, which interacts with the cylinder. In the process, at least one side of the piston faces is urged with a hydraulic fluid, whereby work can be exerted in at least one direction. For example, if both piston faces are urged with hydraulic fluid, the cylinder thereby has two active directions of movement.

It will be understood that, depending on the configuration of the cylinder or of the piston, the roll-stand-side subassembly can represent the hydraulic setting unit. In conjunction with the roll stand and the basic task of being able to set the roll pass, the subassembly on the roll side is regarded as movable and the roll-side subassembly as fixed in position, even if the latter likewise possibly experiences a change of position, due to the rolling forces or due to a further setting device, when the hydraulic pressure or else the rolling forces change.

Preferably, the cylinder comprises the spindle or contains it. Due to this construction, in which especially the central axes of the cylinder and of the spindle can be the same, a very compact construction within the roll stand is possible, because the two subassemblies of the hydraulic setting unit and of the mechanical setting unit are not arranged completely separately from one another, but the cylinder is preferably disposed coaxially relative to the spindle or surrounds it. Due to this arrangement, the cylinder may possibly also be used as an overload safeguard.

The piston may also comprise or contain the spindle, which may be advantageous in particular during use of a hydraulic cylinder with a cylinder-piston arrangement. Hereby a compact construction may also be provided within the roll stand. In particular, when the piston and preferably also the cylinder surround the spindle, an arrangement is possible in which the central axes of the cylinder or of the piston are the same as the axis of symmetry or the same as the central axis of the spindle. Thereby a very compact construction can be provided within the roll stand, because the mechanical setting unit and the hydraulic setting unit can be disposed as simply as possible as a common subassembly.

Advantageously, the force acting on the rolls acts first on the hydraulic setting unit, then on the mechanical setting unit, and thereafter on the roll stand. The force transmission into the rolls therefore preferably takes place first to the hydraulics, then to the mechanics and from there to the roll stand. This force flow ensures that, for setting of the cross rolls, the mechanical setting unit can be used at first for a first load-free setting and the hydraulic setting unit acts as a second adjustment of the rolls under load. Finally, the rolling forces are absorbed by the roll stand. This force action or this flow of force also favors the formation of the mechanical setting unit and of the hydraulic setting unit as a common subassembly. In particular, any forces that must possibly still be absorbed for a mechanical setting, such as rotational or torsional forces, for example, can then be absorbed by the roll stand in structurally simple manner.

Due to a combined setting comprising mechanical, load-free setting as well as the second hydraulic adjustment under load, the control accuracy can be improved. In addition, with a suitable configuration, the natural angular frequency of the setting can be improved hereby. Moreover, with a suitable configuration, the sizes of the hydraulic setting components, such as the valve sizes, for example, can be reduced hereby, because the mechanical setting can be used first for the largest or coarse roll setting and thus less hydraulic power or quantity of hydraulic fluid is needed than, for example, in purely hydraulic settings. It is also conceivable that the setting can take place purely mechanically during a failure of the hydraulics, and under certain circumstances this feature is also possible with higher loads than by the hydraulics. Furthermore, it is conceivable that, when products having less strict requirements, for example, are to be manufactured, it is also possible to operate entirely without hydraulics and the energy demand for regulation does not develop.

Preferably, the spindle can be turned by means of an electric drive, wherein the corresponding specific electric drive can be selected as a torque motor or as a conventional electric motor, for example, depending on requirements, and wherein an electric drive represents a structurally simple drive for a mechanical setting unit.

An "electric drive" can advantageously be a drive that has one or more electric motors and is regulated by a regulating system. If the motor power is high, electronic power control elements are interposed, for example, between the regulating system and the electric motor or electric motors. They are then components of the electric drive.

In order to provide the mechanical set-up of the roll gap, it is possible to turn the spindle by means of a rotary drive. The spindle can be displaced in two directions by turning it while it is guided in a thread. Thus the rotary drive can turn the spindle and hereby set it along the axis of symmetry or central axis of the spindle. Due to an appropriately designed rotary drive, high forces can be applied on the spindle and thus on the rolls, or else be absorbed by the spindle and by the rotary drive. In addition, the rotary drive favors the most compact possible structure of the setting unit.

"Rotary drives" are preferably needed for automation of rotary valves. The basic requirements imposed on rotary drives are described as follows in the EN ISO 5210 standard: A rotary drive is an actuator, which transfers a torque to the valve via at least one full revolution. It is able to absorb thrust forces. In the present connection, a rotary drive transfers the torque correspondingly to the spindle, in order to be able to displace it.

It is advantageous when the rotary drive comprises a worm gear. A worm gear delivers a large total step-up ratio with few steps, whereby it represents an inexpensive version of a rotary drive for large forces. In addition, a self-locking can take place by the worm gear, whereby an additional brake can be provided in case of a possible failure.

Preferably, a combination of helical gears and toothed wheel gears can be understood as a worm gear. It consists preferably of a helical, so-called worm shaft and a toothed wheel, the so-called worm wheel. The thread pitch of the worm shaft engages in the tooth spaces of the worm wheel.

It is indeed conceivable that other gears, such as a traditional toothed wheel gear, can also be used. In contrast to the toothed wheel gear with partly only rolling contact, however, a permanently sliding contact such as occurs in a helical gear is also present in a worm gear. This arrangement is the main reason for the relatively low efficiency at high step-up ratios and the usually necessary cooling of such a gear. However, it is also the reason that the worm gear is able to be the quietest and to be a toothed drive with relatively high load capacity. Because very high forces prevail during cross-rolling, however, the high load capacity of the worm gear can be particularly advantageous.

Preferably, the rotary drive and the electric drive have the same working direction, in order to permit an advantageous energy configuration of the drive for the mechanical setting unit.

Advantageously, the rotary drive is disposed on the outside of the roll stand. Hereby a compact construction of the roll stand together with the rotary drive is possible on the whole. In addition, due to the direct arrangement of the rotary drive on the roll stand, a direct force transfer to the roll stand can take place in the simplest possible way. The entire interplay of hydraulic setting unit and mechanical setting unit as well as the corresponding force transfer between the units and ultimately to the roll stand are particularly advantageous due to this arrangement. In addition, in case of a failure of the hydraulics, the system may also continue to be used as a purely mechanical system.

The arrangement of the rotary drive also permits a most compact possible structure of the roll stand because this structure does not also have to enclose the rotary drive. With reduction in size of the roll stand, it becomes increasingly inexpensive to absorb the respective rolling forces, and fewer significant cases, such as elongations, for example, are caused by the rolling forces.

"Outside" can be understood as the side or the face of the roll stand that is turned away from the actual working region or rolling region. For example, the roll stand can have a frame-like structure, wherein this frame encloses a certain region and the outside of the roll stand correspondingly represents the side of the frame or of the roll stand turned away from the enclosing space. Thus, the rotary drive can be disposed outside a self-contained roll stand.

It is of advantage when a relative movement is possible between the rotary drive and the spindle. In this way, an adjustment of position of the rotating spindle can take place, whereas the drive is fixed in position. The latter permits a simple positioning and supply of the rotary drive. In addition, a length compensation is possible hereby. The rotary drive remaining fixed in position is therefore able to turn the spindle, whereby this spindle is moved relative to the rotary drive and correspondingly displaced. Beyond this feature, however, it is also conceivable that a relative movement between rotary drive and spindle is possible in which the rotary drive is not necessarily disposed in fixed position and, for example, is moved in the direction of or opposite to the direction in which the spindle is moving, and thus also the rotary drive is moved relative to the spindle, without this drive being fixed in position.

It is of advantage when the force acting on the rolls operating under load acts first on the hydraulic setting unit then acts on the rotary drive and/or the electric drive and thereafter acts on the roll stand, as already alluded to in the foregoing. Due to this operating sequence, what takes place during rolling is a force transmission into the hydraulic setting unit and then into the rotary drive or electric drive, which is part of the mechanical setting unit, and thereafter into the roll stand. Thus the hydraulic setting unit can then intercept elastic jolts that emerge from the rolling process and migrate in the direction of the roll stand, before these jolts reach the mechanical setting unit and especially the rotary drive or the electric drive, where such jolts may lead to higher wear or even to damage. This feature is true in particular when the hydraulic setting unit is also equipped with an overload safeguard, such as, for example, an overpressure valve.

On the other hand, it is also conceivable that the force acting on the rolls operating under load acts first on the mechanical setting unit then acts on the hydraulic setting unit and thereafter acts on the roll stand. With a suitable configuration, this configuration can represent a very compact spatial implementation, in that the mechanical setting unit, such as a spindle, for example, extends to a roll seat or another subassembly that is fixed in position relative to a roll, so that then even a maximum stroke can be executed by the mechanical setting unit in the smallest possible overall space. This feature is true in particular when a rotary drive or an electric drive or an associated gear part are decoupled with respect to possible forces directed from the rolls in the direction of the roll stand, which can be achieved, for example, by a corresponding degree of freedom in setting direction of the mechanical setting unit, because then jolts and the like ultimately do not reach these sensitive units and, incidentally, before they reach the roll stand, can likewise be intercepted by the hydraulic setting unit.

In this situation, the rotary drive or the electric drive is able to absorb a large part of the rolling forces. The larger adjustment of the roll gap can take place in load-free condition, and, in the second step, a smaller adjustment of the roll gap can take place hydraulically under load, which is correspondingly possible due to the foregoing operating sequence.

Preferably, the hydraulic setting unit is disposed within a closed frame of the roll stand, whereby a compact structure is permitted, because relatively little overall space is needed even for hydraulic setting units designed for high pressures, especially when only short adjustment distances are to be traveled because, for example, the latter can be taken over by the mechanical setting device.

By "frame" in the present connection, a construction can be denoted that is structurally self-contained and encloses a space disposed within this frame, whereas the space surrounding the frame can be described as outside the frame. Such a frame is particularly suitable for absorbing rolling forces and compensating for them within itself.

Thus, for example, the hydraulic setting unit could be disposed inside the closed frame of the roll stand and simultaneously the mechanical setting unit can be disposed outside the frame or at least partly outside the frame and the hydraulic setting unit and the mechanical setting unit can nevertheless interact directly with one another as a common subassembly. For example, the spindle of the mechanical setting unit can extend from outside the frame to inside the frame, wherein it interacts in the region outside the frame with a rotary drive or electric drive and inside the frame it is in interaction with the hydraulic setting unit.

A frame can be regarded as "closed" in the present connection when it is closed purely structurally or by a continuous frictional connection.

A nut threaded onto the spindle can also form the piston of the hydraulic setting unit, in order to permit a most compact possible construction.

"Nut" can preferably be understood as a threaded nut, which is provided with a female thread and represents the mating piece of a screw or of a threaded stud. In the present connection, the mating piece represents the spindle or the thread of the spindle. Advantageously, the threaded nut is a hollow, usually low prismatic body, the inside face of which is formed as a female thread. The prismatic outer contour serves for connection with a wrench with which the torque for tightening the nut is transmitted. In the present case, a prismatic outer contour does not seem absolutely necessary, provided an appropriate anti-rotation ability can be ensured by other measures, such as, for example, tongues and grooves or by another interlocking ability that is effective in directions of rotation.

When the nut forms the piston of the hydraulic setting unit, it is able to establish a double function, because on the one hand it serves to connect the spindle mechanically with the hydraulic setting unit and simultaneously forms a piston, which can be used as a subassembly of the hydraulic setting unit. Thus a force transfer from the hydraulic setting unit to the mechanical setting unit can take place in the simplest possible way. On the other hand, such an arrangement also permits a coaxial arrangement of the spindle with the piston, especially an arrangement in which the central axis of the piston is the same as the axis of symmetry or the central axis of the spindle, which on the whole further favors the most compact construction possible as well as also improves the regulation accuracy for cross-roll setting.

On the other hand, it would also be conceivable that the hydraulic setting unit is connected in some other way with the mechanical setting unit or is disposed on the roll rack and has a piston of the hydraulic setting unit formed independently of such a nut, when this hydraulic setting unit is to be configured to be displaceable independently of a spindle or the mechanical setting unit.

In order to permit a most compact possible construction as well as a coaxial arrangement of the spindle relative to the cylinder, the cylinder of the hydraulic setting unit can comprise a cylinder cover. It is conceivable that, for example, a nut threaded onto the spindle can also be the piston of the cylinder cover. In addition, an anti-twisting safeguard against a twisting resulting from the rotary drive can also be achieved in this or by this cylinder cover.

In order to achieve the same advantages, the cylinder of the hydraulic drive unit can comprise a cylinder tube. The cylindrical tubular shape permits a coaxial arrangement of the spindle relative to the cylinder, because a cylinder tube, in contrast to a cylinder of solid structure, can surround a spindle when the spindle is disposed inside the cylinder tube or is passed through the cylinder tube.

Advantageously, the spindle is joined directly with the piston via a spindle thread. Due to the hydraulic adjustment, the working position is directly influenced. If, for example, the upper stroke at the piston is set to zero, the setting can be used without hydraulics directly as a purely mechanical setting. This arrangement may then be advantageous, for example, when the hydraulics fail and it is desired to be able to continue setting the rolls, which can then be achieved purely mechanically. If applicable, it may even be possible to work intentionally without hydraulics, if necessary, in order to set the cross rolls in such a way that energy can be saved, because the energy demand for hydraulic control is not present.

It is of advantage when the rolls can be set purely mechanically, because in case of a failure of the hydraulics the system can continue to be used as a purely mechanical system and because, beyond that feature, even loads that may be higher than are possible with the hydraulics can still be countered appropriately. If products having less strict requirements are being manufactured, it may likewise be possible to operate without hydraulics and the energy demand for regulation does not develop.

Advantageously, the position of the spindle is measurable, in order to achieve an exact setting of the rolls. In particular, when a regulation of the roll gap takes place during the rolling, the measuring of the position of the spindle can be very advantageous, in order to be able to check whether the desired position is being maintained at every point in time. A measurement can be implemented readily by suitable position or displacement measuring devices, whether these measurements are relative or absolute.

Moreover, corresponding regulation processes that regulate the exact setting of the rolls during the rolling are permitted by such measurements.

It will be understood that all measuring methods generally familiar to the person skilled in the art and known from the prior art may be used for measuring the position of the spindle. It is conceivable, when both the mechanical setting unit and the hydraulic setting unit are used during setting of the rolls, for the position of a subassembly of the hydraulic setting unit, for example, to be measurable, in order to also determine the exact roll setting from this measurement, because the corresponding distances from the hydraulic subassembly to the roll region are known or can be calculated. In the process, it is possible in particular to determine the position of the spindle within the hydraulic setting unit that encloses the spindle, so that this position is possible for the determination of the exact roll setting via the position of the subassembly of the hydraulic setting unit.

A working region situated between the rolls may also be variable by the spindle. This working region represents the region in which the rolling process takes place, especially therefore the forming region. Depending on specific word selection, the working region is also known as the roll pass. Therefore the roll gap, the roll pass or the working region can also be set up by a displacement of the spindle.

It is conceivable that not only a spindle but also other mechanical constructions can be used that are able to set the rolls appropriately mechanically. In addition, the working region can also be changed by subassemblies of the hydraulic setting unit.

Alternatively or cumulatively with respect to the feature combinations explained at present, a method for adjustment of a roll gap of rolls of a cross-rolling unit operating under load with, disposed on a force-absorbing roll stand, a mechanical setting unit and a hydraulic setting unit, can be characterized in that the mechanical setting unit and hydraulic setting unit disposed in a common subassembly adjust the roll gap, wherein a rolling force acting on the rolls is transferred via the rolls firstly to the hydraulic setting unit, the hydraulic setting unit then transfers this same rolling force to the mechanical setting unit and thereafter the mechanical setting unit transfers the rolling force to the roll stand, in order to permit an adjustment of the roll gap under load with high positioning accuracy and regulation accuracy. In case of suitable configuration, this approach has the advantage that the hydraulic setting unit can serve directly as protection of the mechanical setting unit against jolts, which may arise in the roll pass due to the interaction of the rolls with the workpiece.

Alternatively, a method for adjustment of a roll gap of rolls of a cross-rolling unit operating under load with, disposed on a force-absorbing roll stand, a mechanical setting unit and a hydraulic setting unit, can be characterized in that the mechanical setting unit and hydraulic setting unit disposed in a common subassembly adjust the roll gap, wherein a rolling force acting on the rolls is transferred via the rolls firstly to the mechanical setting unit, the mechanical setting unit then transfers this same rolling force to the hydraulic setting unit and thereafter the hydraulic setting unit transfers the rolling force to the roll stand, in order to permit an adjustment of the roll gap under load with high positioning accuracy and regulation accuracy. This arrangement permits, as already alluded to in the foregoing, a very compact structure, because the mechanical setting unit is able to extend directly to the roll seat or to another subassembly joined with this in fixed position.

Especially in the latter configuration, a suitable decoupling means may be provided in order to protect sensitive subassemblies, such as, for example, certain gear parts or drives, as well as possible from any jolts that arise from the roll pass or from one of the rolls.

Preferably, the setting of the roll gap takes place in load-free condition by means of the mechanical setting unit, in order to permit a better regulation accuracy.

Cumulatively or alternatively, the adjustment of the roll gap takes place by means of the hydraulic setting unit under load. When the mechanical setting unit sets the roll gap in load-free condition or the hydraulic setting unit adjusts the roll gap under load, the regulation accuracy can be improved. In addition, the natural angular frequency of the setting can be improved. Beyond this improvement, less hydraulic power is necessary in case of suitable configuration, because the larger setting distances can take place via the mechanical setting unit and then only the adjustment via the hydraulic setting unit can take place under load, whereby less hydraulic power is therefore needed on the whole. The pressure differences may be used, for example, for a force measurement, in order to serve as input signal for the regulation system.

It is of advantage when the adjustment of the roll gap can also take place under load by means of the mechanical setting unit, because in this way a purely mechanical adjustment of the roll gap during rolling is possible. For example, it is conceivable for the hydraulics to fail and then the rolls of the cross-rolling mill can nevertheless continue to be adjusted purely mechanically. This feature could also have the advantage that the adjustment of the rolls can take place during the rolling process, possibly even under higher loads than with a hydraulic setting unit. In addition, a purely mechanical adjustment could be provided specifically if it were desired, for example, to economize for cost reasons on the energy demand needed for the hydraulic regulation system.

Preferably, an electric drive is able to turn a gear part, such as a spindle, for example, of the mechanical setting unit. As already alluded to in the foregoing, this feature permits an inexpensive and efficient drive, which in addition can be automated and regulated in structurally simple manner.

For a mechanical setting of the roll gap, a gear part, such as a spindle, for example, of the mechanical drive unit, can be turned alternatively or cumulatively by means of a rotary drive. By means of the rotary drive, high forces that arise due to the rolling process can be absorbed or large forces can be applied. In addition, a more compact structure of the mechanical setting unit is possible.

Preferably, the rotary drive or the electric drive is decoupled with respect to possible forces directed from the roll in the direction of the roll stand. This decoupling may also be the case in particular for a corresponding gear element, such as, for example, a toothed wheel, which in turn interacts with the gear part being turned. For example, this feature may be implemented by a decoupling means, such as, for example, by a sliding guide, which indeed transfers rotary forces but not axial forces, or by similar decoupling measures.

Advantageously, the rotary drive is a worm gear, which provides a high total step-up ratio with few steps, so that this arrangement is correspondingly inexpensive. In addition, a worm gear delivers a high self-locking ability and thus in particular an additional braking capacity and thus also additional operating safety in case of a failure.

It is of advantage when the rotary drive or the electric drive turns or drives the corresponding gear element, such as, for example, the spindle, from outside the roll stand. For a compact construction on the whole of the common subassembly, which is comprised both by including the mechanical setting unit and the hydraulic setting unit, the arrangement of the rotary drive or electric drive outside the roll stand is particularly advantageous. In addition, a good force transfer to the roll stand can take place by the corresponding flow of force via the hydraulic setting unit to the mechanical setting unit on the roll stand. Especially in the interplay of hydraulic setting unit and mechanical setting unit as a common subassembly, the arrangement of the rotary drive or electric drive outside the roll stand proves particularly advantageous, because in this way the rotary drive or electric drive can be disposed, for example, directly outside on the roll stand and correspondingly the hydraulic setting unit can be disposed inside the roll stand, wherein the two units interact with one another and the flow of force can take place in the desired way despite very compact construction.

In addition, the position of the gear part, such as, for example, the spindle, can also be measured, in order to permit an exact setting of the rolls.

In particular, a spindle is suitable as a gear part for the mechanical setting unit. Due to the rotation of the spindle, this gear part is moved in two possible directions along its central axis or along its axis of symmetry, so that, during rotation of the spindle in the corresponding direction, the roll gap can be increased or decreased or the roll pass can be varied. It is conceivable that drives of different configuration can also turn and thus displace the spindle appropriately and therefore set the rolls.

Cumulatively or alternatively, the roll gap or the roll pass can be measured in order to be able to set the rolls correspondingly exactly.

In particular, the position of the spindle or of the roll gap can be measured under load, in order that the roll gap can also be regulated appropriately during the rolling.

It is conceivable that the position of the roll gap or the size of the roll gap can be measured directly in some way and that it will be determined correspondingly from this value how the spindle or the hydraulic setting unit must be regulated in order to provide the desired roll gap. It is also conceivable, however, that only the position of the gear element, such as the spindle, will be measured and that the roll gap or the roll pass will be inferred starting from this measurement, which is possible via the corresponding geometric relationships of the gear, such as the spindle, to the roll gap. It would also be conceivable, however, that positions of the subassemblies of the hydraulic setting unit can be measured, in order to determine from this measurement the roll gap or the roll pass via the corresponding geometric relationships and to regulate it correspondingly.

Preferably, the hydraulic setting unit adjusts the roll gap by means of a piston and a cylinder, because in this way a hydraulic cylinder generally known to the person skilled in the art can be provided that is able to generate the corresponding linear movement of the hydraulic setting unit and thus the necessary linear movement that is able to set the rolls.

In order to improve the regulation accuracy further and simultaneously to provide a compact construction in the simplest possible way, the piston or cylinder of the hydraulic setting unit is able to travel coaxially relative to the spindle of the mechanical setting unit during adjustment of the roll gap. During the coaxial process, piston or cylinder is able to surround the spindle appropriately. Hereby no hydraulic cylinder comprising pistons or cylinders has to be disposed separately outside or next to the mechanical setting unit or the spindle. The available space inside the piston or the cylinder can therefore be used logically for the spindle disposed coaxially inside the piston or the cylinder, so that the common subassembly of the hydraulic setting unit and the mechanical setting unit can be formed as compactly as possible.

The piston or the cylinder is also able to enclose the spindle, which permits a coaxial arrangement of piston or cylinder relative to the spindle and thus also a compact construction.

Furthermore, hereby a good force transfer is permitted via the hydraulic setting unit to the mechanical setting unit, because the axis of symmetry of the mechanical setting unit is the same, due to the coaxial relationship, as the central axis of the hydraulic setting unit, i.e. of the piston or of the cylinder. In this way it is also conceivable in particular for the cylinder, as a cylinder tube, to surround the spindle, because a tube has a corresponding inside region in order that a spindle can also be surrounded.

It will be understood that the features of the systems described in the foregoing or in the claims may also be combined if necessary in order to be able to implement the advantages correspondingly cumulatively.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
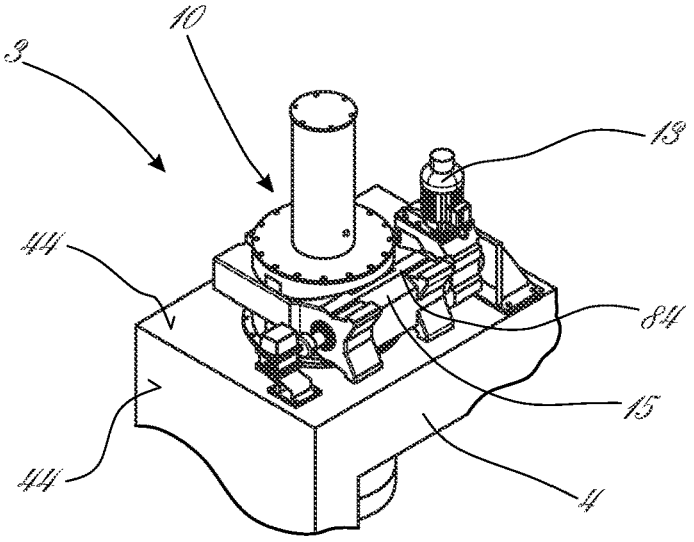
FIG. 1 shows a schematic perspective view of a cross-rolling setting device on a roll stand.
Figure 2:
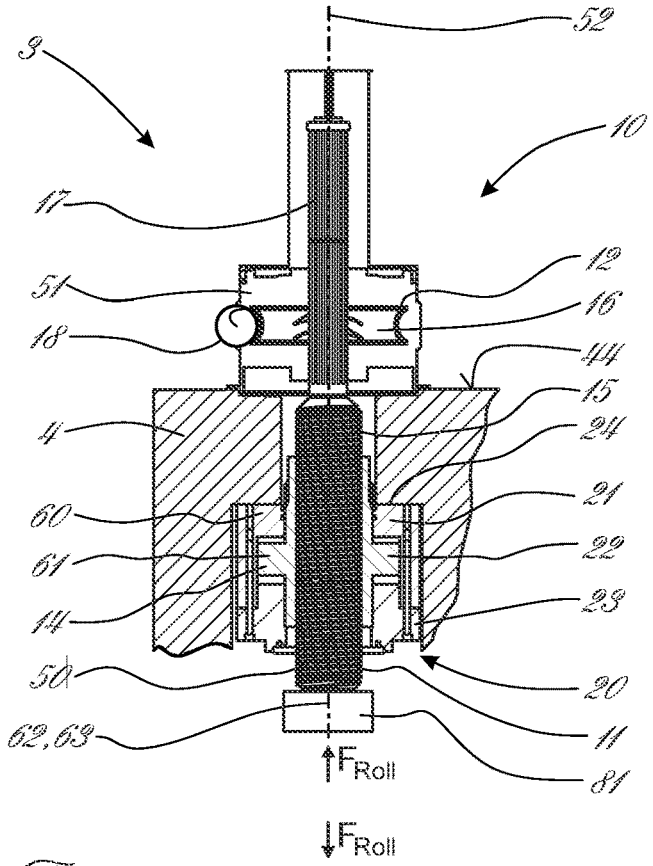
FIG. 2 shows a schematic sectional diagram of the cross-rolling setting device according to FIG. 1.

The cross-rolling device 3 illustrated in FIGS. 1 and 2 comprises a mechanical setting unit 10 as well as a hydraulic setting unit 20, which are disposed as a common subassembly on a roll stand 4.

The mechanical setting unit 10 comprises a spindle 11, a rotary drive 12 and an electric drive 13. The rotary drive 12 as well as the electric drive 13 are disposed on an outside 44 of the roll stand 4 and joined there with an upper part of the spindle 11.

Thus, a part of the spindle 11 is situated outside the roll stand 4. The further part of the spindle 11 projects through the roll stand 4 into the interior of the roll stand, wherein the part of the spindle 11 that is not situated outside the roll stand 4 has a spindle thread 15.

The rotary drive 12 comprises a worm gear 18 and, driven by the worm gear 18, a toothed wheel 16, which via a decoupling means 17 formed by a sliding guide is able to drive the spindle 11, and with the electric drive 13 drives the spindle 11 from outside the roll stand 4 and turns this spindle around an axis of symmetry 52 of the spindle 11.

The rotary drive 12 therefore represents, together with the spindle thread 15, a first mechanical subassembly 50 of the mechanical setting unit 10, whereas the spindle 11 forms a second mechanical subassembly 51 of the mechanical setting unit 10. Thus a first mechanical subassembly 50 of the mechanical setting unit 10 can be displaced toward a second mechanical subassembly 51 of the mechanical setting unit 10.

The hydraulic setting unit 20 is disposed inside the roll stand 4 of the common subassembly that comprises the mechanical setting unit 10 and the hydraulic setting unit 20. The hydraulic setting unit 20 comprises a first hydraulic subassembly 60 having a central axis 62 and a second hydraulic subassembly 61 having a central axis 63, wherein the two central axes 62, 63 are the same.

In the present exemplary embodiment, the first hydraulic subassembly 60 is formed as a cylinder 21 in the form of a cylinder tube 24 and the second hydraulic subassembly 61 is formed as a piston 22. In addition, the cylinder 21 has a cylinder cover 23. The arrangement of a cylinder 21 and a piston 22 therefore represents a hydraulic cylinder-piston unit consisting of cylinder 21 and a piston 22.

The mechanical setting unit 10 as well as the hydraulic setting unit 20 are disposed in such a way on the roll stand 4 that the common axis of symmetry 52 of the mechanical subassemblies 50, 51 is the same as the central axes 62, 63 of the hydraulic subassemblies 60, 61. This hydraulic setting unit 20 is disposed in such a way that the piston 22 or the cylinder 21 surrounds the spindle 11.

The piston 22 is configured with a female thread, so that this thread can engage directly in the spindle thread 15 of the spindle 11. In this way, the piston 22 serves not only the function as a piston 22 for the hydraulic setting unit 20 but also as a nut 14, which therefore can be regarded inherently as likewise part of the mechanical subassembly 50 of the roll-stand-side mechanical setting unit 10.

The rotary drive 12 or the electric drive 13 drive the spindle 11, which is turned and operatively connected via the spindle thread 15 with the nut 14 and thus with the hydraulic setting unit 20. The spindle 11 is turned and is thereby moved along its axis of symmetry 52 in one direction or the other depending on the direction of rotation.

Because the spindle 11 is joined with a roll seat 81 inside the roll stand 4, the roll seat 81 can be set in this way by the mechanical setting unit 10 and thus also set by the rolls 80 carried by the roll seat 81.

With the mechanical setting unit 10 of the present exemplary embodiment, rolls 80 or a roll seat 81 can therefore be set in load-free condition in a first step if necessary, wherein this setting makes up the largest part of the entire necessary setting.

After the roll seat 81 has been set appropriately for a rolling process by the mechanical setting unit 10 in the first step, it or the rolls 80 can be adjusted under load by the hydraulic setting unit 20 in a second step. This second adjustment by the hydraulic setting unit 20 takes place via a much shorter adjustment distance than in comparison with the first setting and may even take place during the rolling process. In the process, cylinder 21 and piston 22 of the hydraulic setting unit 20 operate as a hydraulic cylinder, so that a first load-free setting can take place mechanically and a second setting can take place hydraulically under load, especially during the rolling process.

It will be understood that the hydraulic setting unit 20 may possibly also be adjusted without load if this adjustment seems necessary. Likewise, in a preferred embodiment, the mechanical setting unit can be adjusted under load, which appears feasible even at large rolling forces, in particular by the step-up ratios between spindle 11 and spindle thread 15 as well as between toothed wheel 16 and worm gear 18.

With suitable configuration, the toothed wheel 16 and the worm gear 18 or the spindle 11 and/or the spindle thread 15 can be designed in such a way that a self-locking capacity can act in energy-saving manner under specific circumstances.

The forces or rolling forces that arise during rolling act via the roll seat 81 firstly on the spindle as part of the mechanical setting unit 10 and then act on the hydraulic setting unit 20. Due to the hydraulic setting unit 20, the forces are then transferred to the roll stand 4, so that a flow of force arising due to the rolling forces operates via the mechanical setting unit 10, then via the hydraulic setting unit 20, and thereafter on the roll stand 4.

Due to the manner in which the common subassembly consisting of mechanical setting unit 10 and hydraulic setting unit 20 is able to move the roll seat 81, a relative movement between the rotary drive 12 and the spindle 11 is necessary, so that the rotary drive 12 remains in fixed position, the spindle 11 turns and is displaced correspondingly. This feature is achieved by the decoupling means 17, which also decouples jolts directed parallel to the axis of symmetry 52 or to the central axes 62, 63, which may travel from the rolls 80 possibly to the rotary drive 12 or to the electric drive 13.

It is conceivable for the roll stand 4 to be formed as a closed frame, which is not visible from the detailed illustration in FIGS. 1 and 2. By an appropriately closed frame, a closed flow of force can also be provided.

Beyond this feature, the roll seat 81 in the arrangement of the present exemplary embodiment can be set purely mechanically via the mechanical setting unit 10. During a possible failure of the hydraulic setting unit 20 or of one of the subassemblies 60, 61, the cross-roll setting device 3 can continue to be used. Possibly even higher loads than with the hydraulic setting unit 20 could be managed by such a purely mechanical setting or adjustment. In addition, exclusively a mechanical setting may also take place intentionally by the mechanical setting unit 10 if, for example, products with less strict requirements must be manufactured and in this way the energy demand for the regulation of the hydraulics can be saved and thus it is possible to dispense intentionally with an adjustment by the hydraulic setting unit 20.

The cross-rolling units 1 illustrated in FIGS. 3 to 6 respectively comprise at least 2 rolls 80 (see FIGS. 3 and 4) or 3 rolls 80 (see FIGS. 5 and 6), which are mounted respectively in their roll seats 81, which in turn are mounted via a cross-roll setting device 3 on a roll stand 4.

The rolls 80 are able to rotate around roll axes 85 and have roll surfaces 86, which come or are able to come into contact with an elongated workpiece, not illustrated in the figures.

In the process, a possible workpiece runs substantially along a roll centerline 2, which roughly represents the material center of gravity of the traveling material and—stated more precisely—represents the axis from an infeed roller table, not illustrated, through the center of the rolling unit to an outfeed roller table, not illustrated.

These roll axes 85 are aligned substantially parallel to the roll centerline 2, wherein a small angle of inclination between 5° and 8° is provided in the present exemplary embodiment. In deviating embodiments, it is obvious that other angles of inclination, possibly even relative to the horizontal, may also be provided here.

The rolls 80 themselves have a relatively complex roll surface 86, which for its part then leads in turn to a relatively complex roll pass or working region 30 and especially also to a different load of the respective roll seats 81 of a roll 80. This feature means that the roll axes 85 may also be inclined relative to the horizontal, which possibly may also be provided already without load by analogy with cross-roll unit 1.

Figure 3:
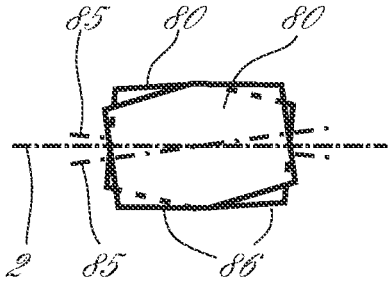
FIG. 3 shows a schematic aspect of two cross rolls of a cross-rolling unit.
Figure 4:
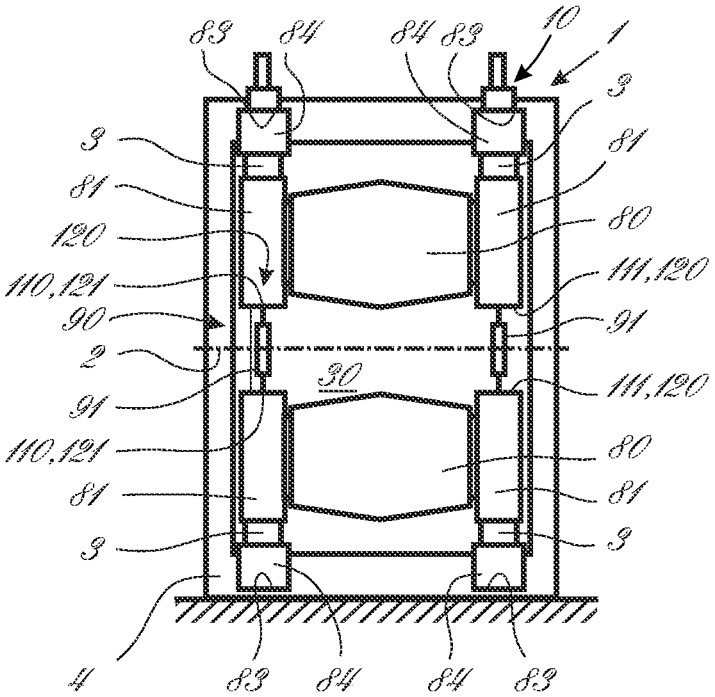
FIG. 4 shows a schematic side view of a first cross-rolling unit with the cross rolls according to FIG. 3.

The roll-positioning device of the exemplary embodiment illustrated in FIGS. 3 and 4 are joined via longitudinal spars, which serve as engagement stations 84, with the roll stand 4, so that the rolling forces are transmitted into the roll stand 4 via the engagement stations 84 or via the connection between the engagement stations 84 and the roll stand 4, which can be denoted as engaging end 83, which leads to a corresponding spring-back of the roll stand 4, which ultimately can lead, by analogy with the unequal loading of the rolls 80 and the roll seats 81 already alluded to in the foregoing, to a corresponding unequal loading of the roll stand 4.

Figure 5:
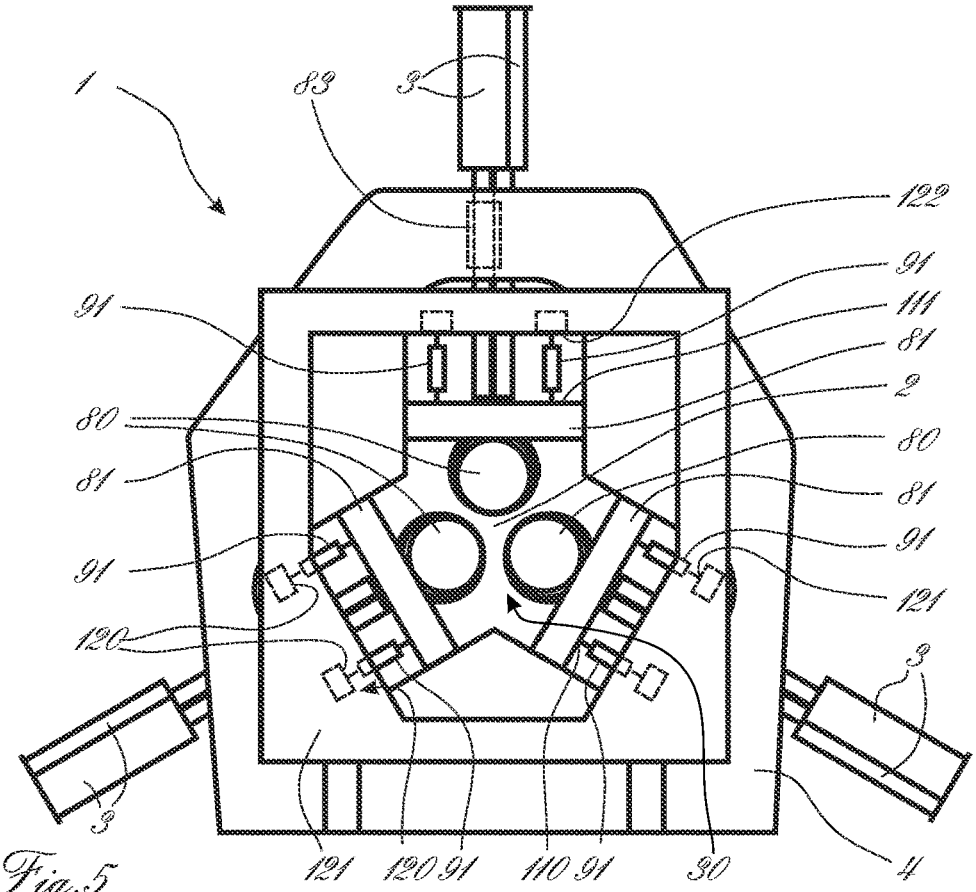
FIG. 5 shows a schematic front view of a second cross-rolling unit.
Figure 6:
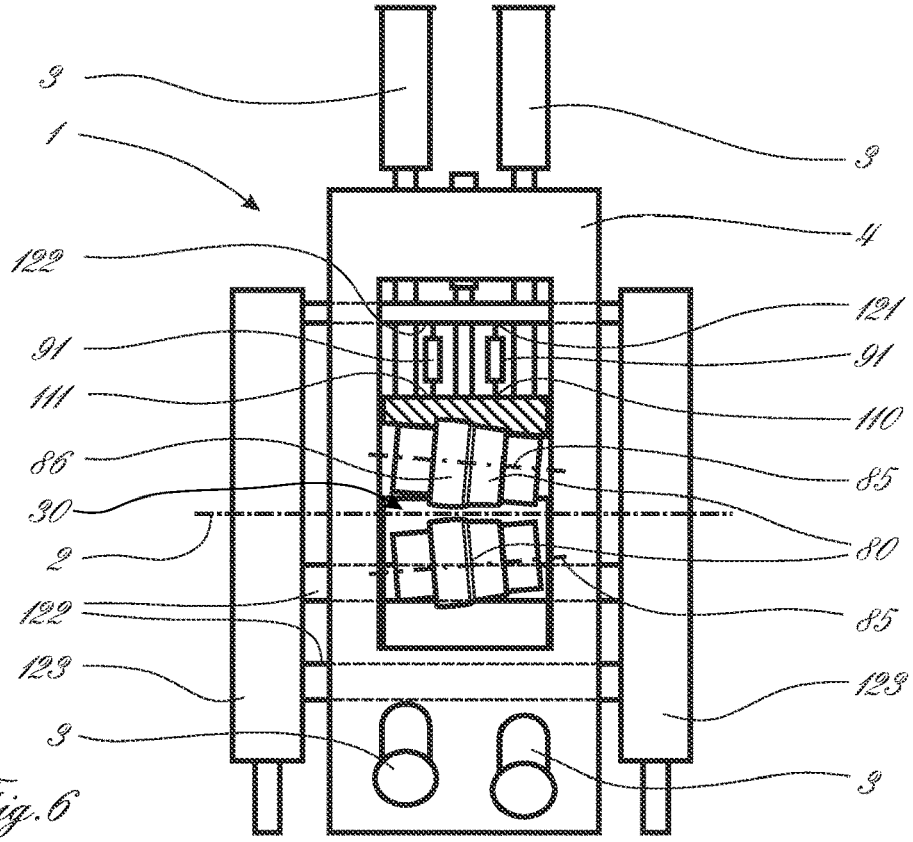
FIG. 6 shows a schematic side view of the second cross-rolling unit.

In the exemplary embodiments illustrated in FIGS. 5 and 6, a solid roll stand 4 is provided, in which a cross-roll setting device 3, as was already explained on the basis of FIGS. 1 and 2, is introduced. A roll stand 4 of corresponding solid structure can likewise be used in the exemplary embodiments illustrated in FIGS. 1 to 4.

In the arrangements according to FIGS. 4 to 6, each roll seat 81 is mounted in settable relationship by two cross-roll setting devices 3 on the roll stand 4. Hereby it is also possible in particular to set the roll axes 85 at their angle relative to the roll centerline 2, or it is also possible to counter non-uniform load changes.

Because two cross-roll setting devices 3 are mounted in settable relationship on the roll stand 4 in the exemplary embodiment according to FIG. 4, the two roll seats 81 are consequently also mounted in settable relationship on the roll stand 4 by two setting units 10, 20. It is conceivable that more than two cross-roll devices 3 or setting units 10, 20 can also be disposed on one roll stand 4. To this extent, a corresponding axis of symmetry may possibly also be defined due to the symmetry of the two setting units 10, 20.

During rolling, the roll surface 86 of the rolls 80 has a component of movement perpendicular to the roll centerline 2 of the cross-rolling unit 1, as is immediately obvious from the figures. As a rule, it follows accordingly that the roll surface 86 of the rolls 80 has, during rolling, a component of movement perpendicular to the direction of movement of the workpiece through the cross-rolling unit 1. The axes 85 of the two rolls 80 also have a component parallel to the roll centerline 2 of the cross-rolling unit 1, as is immediately recognizable from the figures.

In the exemplary embodiment illustrated in FIG. 4, the distance between the two roll seats 81 of the two rolls 80 is measured, in that a distance measuring system 91 is disposed respectively between the roll markers 110 on the roll seats 81 and reference markers 120 disposed on the respective roll seat 81, wherein the measurement can take place directly even during the rolling. In this situation, the roll marker 110 of a first roll seat 81 can be denoted specifically as the reference marker 120 of the second roll seat 81 using the same distance measuring system 91. It will be understood that, in a deviating embodiment, it is possible to use only a single distance measuring system 91, which then is situated only between two roll seats 81 or markers 110, 120, which respectively are provided on one of the two rolls 80, although possibly this arrangement may then concern, but only by analogy, a somewhat more imprecise statement about the respective roll pass.

In this exemplary embodiment, the respective ends of the distance measuring system 91 are attached directly on the roll seats 81, so that the roll seats 81 themselves serve as roll marker points 111 or reference marker points 121. Accordingly, the roll seats 81 also serve as the respective reference for the measurement of the distance 90 to the respective other roll seat 81. It will be understood that, in the exemplary embodiment according to FIG. 4, possibly also separate subassemblies may also serve as the roll marker points 111 or reference marker points 121. It is also possible that other subassemblies, such as, for example, subassemblies provided between the roll positioning devices 82 and the roll seats 81 or the longitudinal or upright spars will be used correspondingly or that corresponding separate subassemblies will serve as carriers of the roll marker points 111 or reference marker points 121.

In the exemplary embodiment illustrated in FIGS. 5 and 6 respectively, shoulders are provided as the roll marker points 111 or reference marker point 121, wherein the shoulders for the roll marker point 111 on the roll seats 81 and the shoulders for the reference marker points 121 are disposed on a separate reference rack 122.

The reference rack 122 is decoupled from the roll stand 4, so that this provides a reference or a reference marker 120 independently of the respective rolling forces. The roll marker points 111 or the roll markers 110 are provided on the roll seats 81, although in deviating embodiments they may also be provided on other subassemblies.

In the exemplary embodiment illustrated in FIGS. 5 and 6 also, possibly a distance measurement may take place between the rolls 80 or the roll seats 81 among one another, as is illustrated by way of example on the basis of the exemplary embodiments illustrated in FIG. 4.

As is immediately obvious, in the exemplary embodiments according to FIGS. 5 and 6, the distance between the roll seats 81 of the rolls 80 and a reference provided outside the engaging end 83 is measured. For this purpose, the reference marker 120 is disposed outside the engagement station 84 of the roll positioning device, engaging with the roll stand 4, of the roll seat 81.

In the present exemplary embodiment, resistance sensors, capacitive sensors and/or inductive sensors are used as the distance measuring system 91 or for distance measurement. Alternatively, optical range finders, ultrasonic sensors or radar sensors can also be used accordingly.

Accordingly, a contact-based or even contactless measurement may be undertaken.

Although only a few embodiments of the present invention have been shown and described, it is to be understood that many changes and modifications may be made thereunto without departing from the spirit and scope of the invention.

What is claimed is:

1. A cross-rolling unit for adjusting rolls operating under load comprising:

(a) a force-absorbing roll stand;

(b) a subassembly disposed on the force-absorbing roll stand comprising a mechanical setting unit for a first cross-roll setting and a hydraulic setting unit for a second cross-roll setting;

wherein the mechanical setting unit comprises mutually displaceable first and second mechanical subassemblies having a common axis of symmetry;

wherein the first mechanical subassembly is a spindle;

wherein cross-rolling unit further comprises at least one of a rotary drive and an electric drive configured to turn the spindle;

wherein the hydraulic setting unit comprises mutually displaceable first and second hydraulic subassemblies having a first central axis and a second central axis, respectively;

wherein the axis of symmetry and the first and second central axes are identical; and wherein a force acting on one of the rolls operating under load acts first on the hydraulic setting unit, then acts on the rotary drive or the electric drive, and thereafter acts on the roll stand.

2. The cross-rolling unit according to claim 1, wherein the first hydraulic subassembly is a cylinder.

3. The cross-rolling unit according to claim 1, wherein the second hydraulic subassembly is a piston.

4. The cross-rolling unit according to claim 1, wherein the rotary drive comprises a worm gear.

5. The cross-rolling unit according to claim 1, wherein the rotary drive and the electric drive have an identical working direction.

6. The cross-rolling unit according to claim 1, wherein the rotary drive is disposed on an outside of the roll stand.

7. The cross-rolling unit according to claim 1, wherein a relative movement between the rotary drive and the spindle is possible.

8. The cross-rolling unit according to claim 1, wherein the hydraulic setting unit is disposed inside a closed frame of the roll stand.

9. The cross-rolling unit according to claim 1, wherein a nut threaded onto the spindle forms a piston of the hydraulic setting unit.

10. The cross-rolling unit according to claim 2, wherein the cylinder comprises a cylinder cover or a cylinder tube.

11. The cross-rolling unit according to claim 1, wherein a position of the spindle is measurable.

12. A cross-rolling unit for adjusting rolls operating under load comprising:

(c) a force-absorbing roll stand;

(d) a subassembly disposed on the force-absorbing roll stand comprising a mechanical setting unit for a first cross-roll setting and a hydraulic setting unit for a second cross-roll setting;

wherein the mechanical setting unit comprises mutually displaceable first and second mechanical subassemblies having a common axis of symmetry;

wherein the first mechanical subassembly is a spindle;

wherein the hydraulic setting unit comprises mutually displaceable first and second hydraulic subassemblies having a first central axis and a second central axis, respectively;

wherein the axis of symmetry and the first and second central axes are identical; and wherein the spindle is joined via a spindle thread directly with a piston of the second hydraulic subassembly.

13. The cross-rolling unit according to claim 12, wherein a force acting on one of the rolls operating under load acts first on the hydraulic setting unit, then acts on the mechanical setting unit, and thereafter acts on the roll stand, or wherein a force acting on one of the rolls operating under load acts first on the mechanical setting unit, then acts on the hydraulic setting unit, and thereafter acts on the roll stand.

14. The cross-rolling unit according to claim 13, wherein at least one of the rolls can be set entirely mechanically.

15. The cross-rolling unit according to claim 13, wherein the spindle is configured to vary a working region situated between the rolls.

* * * * *